US010526767B2

(12) United States Patent
Hijikata et al.

(10) Patent No.: US 10,526,767 B2
(45) Date of Patent: Jan. 7, 2020

(54) CONSTRUCTION MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 53 days.

(21) Appl. No.: 15/556,103

(22) PCT Filed: Sep. 29, 2015

(86) PCT No.: PCT/JP2015/077591
§ 371 (c)(1),
(2) Date: Sep. 6, 2017

(87) PCT Pub. No.: WO2017/056199
PCT Pub. Date: Apr. 6, 2017

(65) Prior Publication Data

US 2018/0274208 A1 Sep. 27, 2018

(51) Int. Cl.
*E02F 9/22* (2006.01)
*F15B 21/14* (2006.01)
(Continued)

(52) U.S. Cl.
CPC ..... *E02F 9/2217* (2013.01); *E02F 3/425* (2013.01); *E02F 9/2285* (2013.01);
(Continued)

(58) Field of Classification Search
CPC ..... F15B 13/06; F15B 13/07; F15B 21/14; F15B 2211/88; E02F 9/2217
(Continued)

(56) References Cited

U.S. PATENT DOCUMENTS 6,378,301 B2 * 4/2002 Endo ..... E02F 9/2217 60/414
9,903,393 B2 * 2/2018 Wu ..... E02F 9/2282
(Continued)

FOREIGN PATENT DOCUMENTS

EP 2 738 397 A1 6/2014
JP 2004-346485 A 12/2004
(Continued)

OTHER PUBLICATIONS

International Preliminary Report on Patentability (PCT/IB/338 & PCT/IB/373) issued in PCT Application No. PCT/JP2015/077591 dated Apr. 12, 2018, including English translation of document C2 (Japanese-language Written Opinion (PCT/ISA/237)) previously filed on Sep. 6, 2017(six pages).
(Continued)

*Primary Examiner* — Thomas E Lazo
*Assistant Examiner* — Michael Quandt
(74) *Attorney, Agent, or Firm* — Crowell & Moring LLP

(57) ABSTRACT

Provided is a construction machine allowing regeneration of a return hydraulic fluid at the time of both a boom raising operation and a boom lowering operation with a small number of valves, making it possible to secure a satisfactory operability at the time of both the boom raising operation and the boom lowering operation.
The construction machine includes: a first hydraulic actuator; a second hydraulic actuator; a tank; and a first hydraulic pump supplying a hydraulic fluid to the second hydraulic actuator, the construction machine further including: a return hydraulic fluid selection device selecting a supply source of a return hydraulic fluid generated at a time of a raising operation or a lowering operation of the first hydraulic actuator and discharging the return hydraulic fluid; a regeneration line supplying the hydraulic fluid discharged from
(Continued)

the return hydraulic fluid selection device to a portion between the second hydraulic actuator and the first hydraulic pump to regenerate the hydraulic fluid; a discharge line discharging the hydraulic fluid discharged from the return hydraulic fluid selection device to the tank; and a regeneration/discharge flow rate adjustment device capable of adjusting a flow rate of the hydraulic fluid flowing through the regeneration line and a flow rate of the hydraulic fluid flowing through the discharge line.

8 Claims, 8 Drawing Sheets

(51) Int. Cl.
*F15B 13/06* (2006.01)
*E02F 3/42* (2006.01)
*E02F 3/32* (2006.01)

(52) U.S. Cl.
CPC ..... *E02F 9/2292* (2013.01); *F15B 13/06* (2013.01); *F15B 21/14* (2013.01); *E02F 3/32* (2013.01); *E02F 9/2235* (2013.01); *E02F 9/2242* (2013.01); *E02F 9/2296* (2013.01); *F15B 2211/46* (2013.01); *F15B 2211/5153* (2013.01); *F15B 2211/5156* (2013.01); *F15B 2211/78* (2013.01); *F15B 2211/88* (2013.01)

(58) Field of Classification Search
USPC ..... 60/424; 91/520
See application file for complete search history.

(56) References Cited

U.S. PATENT DOCUMENTS

| | | | | |
|---|---|---|---|---|
| 9,932,999 | B2 * | 4/2018 | Ueda | F15B 21/14 |
| 2003/0150210 | A1 | 8/2003 | Shimada | |
| 2004/0068983 | A1 | 4/2004 | Kajita | |
| 2007/0028607 | A1 | 2/2007 | Ishikawa et al. | |
| 2010/0031649 | A1 | 2/2010 | Nakamura | |
| 2015/0204359 | A1 * | 7/2015 | Wu | E02F 9/2282 60/428 |

FOREIGN PATENT DOCUMENTS

| | | | | |
|---|---|---|---|---|
| JP | 2008-150860 | A | 7/2008 | |
| JP | 4213473 | B2 | 1/2009 | |
| JP | 4562948 | B2 | 10/2010 | |
| JP | 5296570 | B2 | 9/2013 | |
| JP | 2015-137714 | A | 7/2015 | |
| WO | WO-2014091685 | A1 * | 6/2014 | F15B 21/14 |

OTHER PUBLICATIONS

International Search Report (PCT/ISA/210) issued in PCT Application No. PCT/JP2015/077591 dated Dec. 22, 2015 with English-language translation (five (5) pages).
Japanese-language Written Opinion (PCT/ISA/237) issued in PCT Application No. PCT/JP2015/077591 dated Dec. 22, 2015 (three (3) pages).
Extended European Search Report issued in counterpart European Application No. 15905353.7 dated Apr. 25, 2019 (seven (7) pages).

* cited by examiner

CONSTRUCTION MACHINE

TECHNICAL FIELD

The present invention relates to a construction machine and, more specifically, to a construction machine such as a hydraulic excavator equipped with a hydraulic actuator and a regeneration circuit regenerating a hydraulic fluid from the hydraulic actuator.

BACKGROUND ART

Regarding a construction machine, there is known a technique regenerating the return hydraulic fluid from the hydraulic actuator via a control valve in order to improve the fuel efficiency of the engine and to attain energy saving. Examples of the technique are disclosed in Patent Document 1 and Patent Document 2.

Patent Document 1 discloses a hydraulic control system in which a power discharged from a bottom side hydraulic fluid chamber when a boom cylinder for driving a work device of a construction machine falls due to its own weight is regenerated for the driving of another hydraulic actuator via a control valve.

Patent Document 2 discloses a hydraulic drive system in which a high pressure hydraulic fluid in a rod side hydraulic fluid chamber of a boom cylinder is regenerated in a bottom side hydraulic fluid chamber of an arm cylinder at the time of excavating when the hydraulic excavator performs a combined operation of boom raising and arm crowding in order to efficiently utilize the return hydraulic fluid, which is discharged to a tank in the prior art.

PRIOR ART DOCUMENTS

Patent Documents

Patent Document 1: Japanese Patent No. 5296570
Patent Document 2: Japanese Patent No. 4562948

SUMMARY OF THE INVENTION

Problem to be Solved by the Invention

According to the prior-art techniques described above, it is possible to attain energy saving since the return hydraulic fluid from the boom cylinder can be regenerated at the time of the boom lowering operation or the boom raising operation. However, both the prior-art documents solely describe the regeneration of the return hydraulic fluid at the time of one of the boom lowering operation and the boom raising operation. None of these documents refers to a technique applying to the regeneration of the return hydraulic fluid at the time of both the boom raising operation and the boom lowering operation.

When an attempt is made based on the prior art to regenerate the return hydraulic fluid at the time of both the boom raising operation and the boom lowering operation, four valves in total are required: a valve for discharging the return hydraulic fluid to the tank at the time of the boom raising operation, a valve for regenerating the return hydraulic fluid at this time, a valve for discharging the return hydraulic fluid to the tank at the time of the boom lowering operation, and a valve for regenerating the return hydraulic fluid at this time. Thus, the hydraulic apparatus may become larger.

Further, to maintain the operability, it is necessary to properly control the discharge amount to the tank and the regeneration flow rate at the time of the boom raising operation and the boom lowering operation. For example, a simple switching circuit would bring the operator a feeling of great strangeness. Thus, a complicated circuit is required, and the productivity may be deteriorated.

The present invention has been made in view of the above circumstances. It is an object of the present invention to provide a construction machine allowing regeneration of a return hydraulic fluid at the time of both a boom raising operation and a boom lowering operation with a small number of valves, making it possible to secure a satisfactory operability at the time of both the boom raising operation and the boom lowering operation.

Means for Solving the Problem

To achieve the above object, there is adopted, for example, a construction as claimed in the appended claims. The present application includes a plurality of means for achieving the above object. According to one example thereof, there is provided a construction machine including: a first hydraulic actuator; a second hydraulic actuator; a tank; and a first hydraulic pump supplying a hydraulic fluid to the second hydraulic actuator, the construction machine further including: a return hydraulic fluid selection device selecting a supply source of a return hydraulic fluid generated at a time of a raising operation or a lowering operation of the first hydraulic actuator and discharging the return hydraulic fluid; a regeneration line supplying the hydraulic fluid discharged from the return hydraulic fluid selection device to a portion between the second hydraulic actuator and the first hydraulic pump to regenerate the hydraulic fluid; a discharge line discharging the hydraulic fluid discharged from the return hydraulic fluid selection device to the tank; and a regeneration/discharge flow rate adjustment device capable of adjusting a flow rate of the hydraulic fluid flowing through the regeneration line and a flow rate of the hydraulic fluid flowing through the discharge line.

Effects of the Invention

According to the present invention, it is possible to regenerate the return hydraulic fluid at the time of both the boom raising operation and the boom lowering operation with a small number of valves, making it possible to secure a satisfactory operability at the time of both the boom raising operation and the boom lowering operation.

MODES FOR CARRYING OUT THE INVENTION

In the following, embodiments of the construction machine of the present invention will be described with reference to the drawings.

[Embodiment 1]

Figure 1:
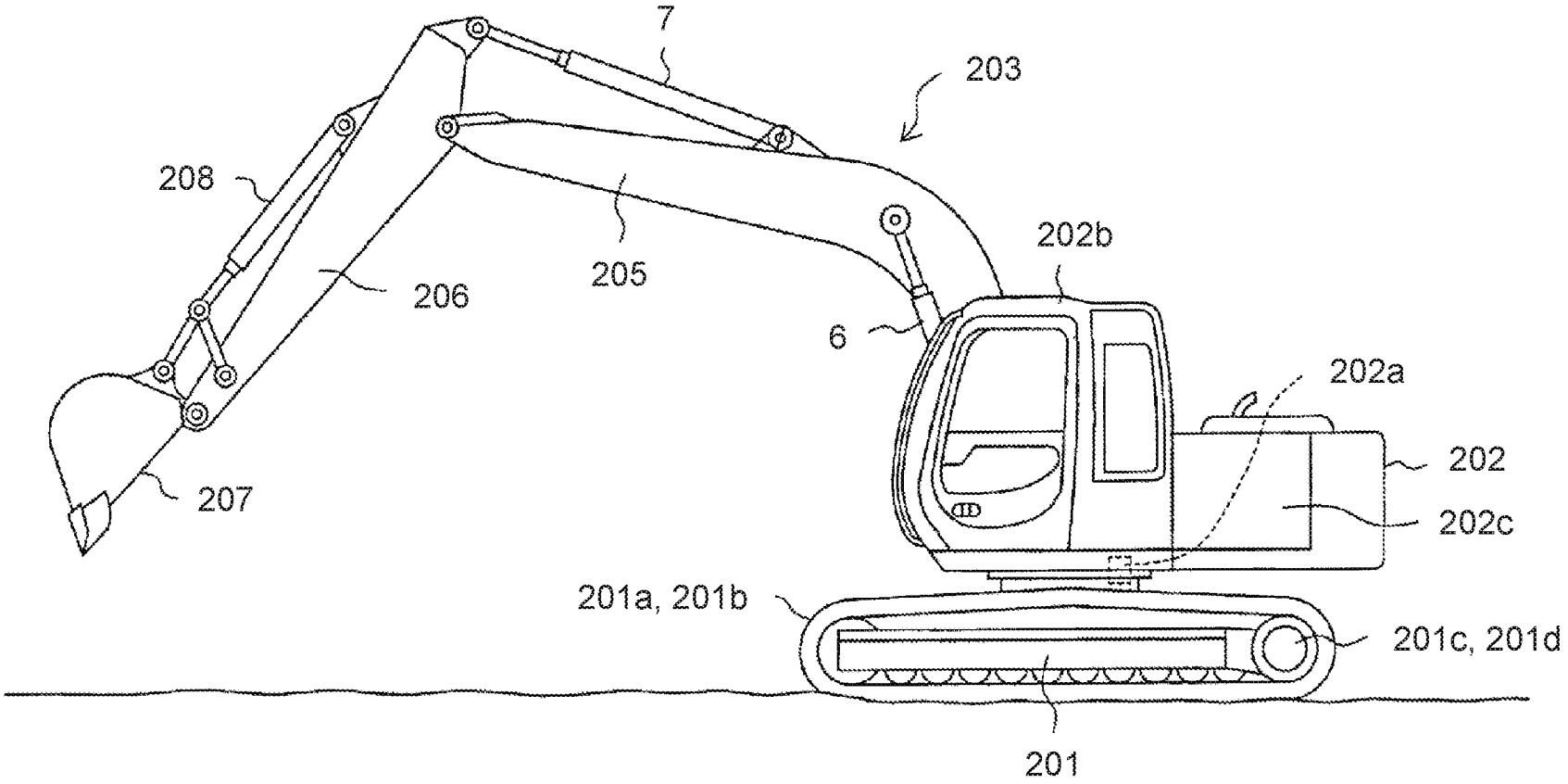
FIG. 1 is a side view of a hydraulic excavator constituting a construction machine according to a first embodiment of the present invention.
Figure 2:
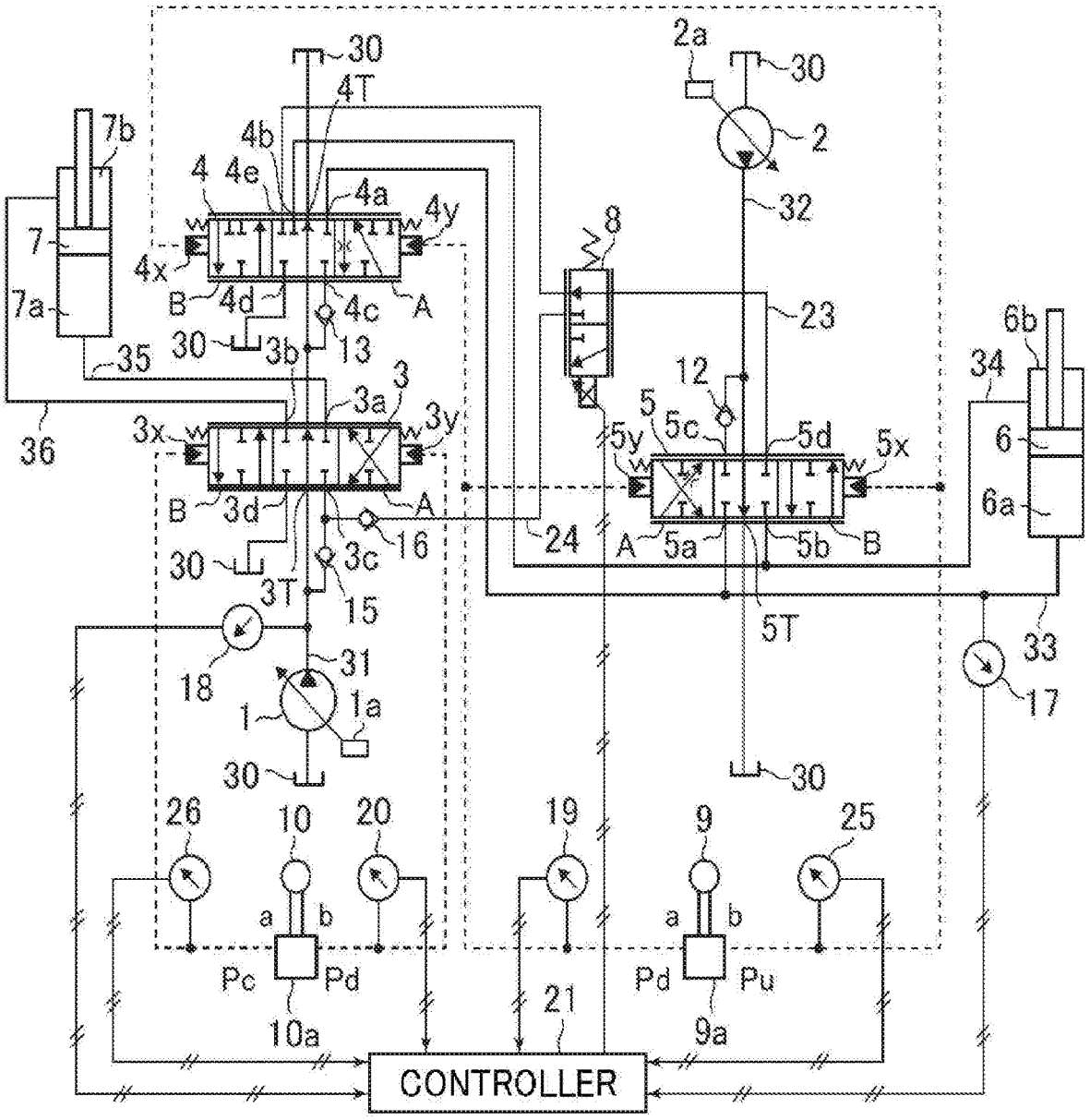
FIG. 2 is a schematic diagram illustrating a hydraulic drive system constituting the construction machine according to the first embodiment of the present invention.

FIG. 1 is a side view of a hydraulic excavator constituting a construction machine according to a first embodiment of the present invention, and FIG. 2 is a schematic diagram illustrating a hydraulic drive system constituting the construction machine according to the first embodiment of the present invention.

In FIG. 1, a hydraulic excavator is equipped with a lower track structure 201, an upper swing structure 202, and a front work device 203. The lower track structure 201 has left and right crawler type track devices 201*a*, 201*a* (only one side of which is shown), which are driven by left and right track motors 201*b*, 201*b* (only one side of which is shown). An upper swing structure 202 is swingably mounted on the lower track structure 201, and is swingably driven by a swing motor 202*a*. The front work device 203 is mounted to the front portion of the upper swing structure 202 so as to be capable of being elevated. The upper swing structure 202 is equipped with a cab (operation room) 202*b*, and an operation device described below is arranged inside the cab 202*b*.

The front work device 203 is of a multi-joint structure having a boom 205 (first driven structure), an arm 206 (second driven structure), and a bucket 207. The boom 205 rotates in the vertical direction with respect to the upper swing structure 202 through expansion and contraction of a boom cylinder 3, which is a first hydraulic actuator. The arm 206 rotates in the vertical direction and the front-rear direction with respect to the boom 205 through expansion and contraction of an arm cylinder 7, which is a second hydraulic actuator. The bucket 207 rotates in the vertical direction and the front-rear direction with respect to the arm 206 through expansion and contraction of a bucket cylinder 208.

FIG. 2 shows a hydraulic drive system constituting the present embodiment. It only shows a system related to the boom cylinder 6 and the arm cylinder 7. This hydraulic drive system is equipped with: variable displacement type first hydraulic pump 1 and second hydraulic pump 2 driven by an engine (not shown); a boom cylinder 6 (first hydraulic actuator) to which a hydraulic fluid is supplied from at least one of the first hydraulic pump 1 and the second hydraulic pump 2 and which drives the boom 205 of the hydraulic excavator; an arm cylinder 7 (second hydraulic actuator) to which the hydraulic fluid is supplied from at least one of the first hydraulic pump 1 and the return hydraulic fluid of the boom cylinder 6 and which drives the arm 206 of the hydraulic excavator; a control valve 3 controlling the flow (flow rate and direction) of the hydraulic fluid supplied to the arm cylinder 7 from the first hydraulic pump 1; a discharge valve 4 controlling the flow (flow rate and direction) of the hydraulic fluid supplied from the first hydraulic pump 1 to the boom cylinder 6 and the discharge flow rate of the return hydraulic fluid of the boom cylinder 6; a return hydraulic fluid selection valve 5 as a return hydraulic fluid selection device controlling the flow (flow rate and direction) of the hydraulic fluid supplied from the second hydraulic pump 2 to the boom cylinder 6 and selecting the supply source of the return hydraulic fluid of the boom cylinder 6; a regeneration control valve 8 controlling the regeneration flow rate and the discharge flow rate of the return hydraulic fluid; a first operation device 9 outputting an operation command for the boom 205 and switching between the discharge valve 4 and the return hydraulic fluid selection valve 5; and a second operation device 11 outputting an operation command for the arm 206 and switching the control valve 3. The first hydraulic pump 1 and the second hydraulic pump 2 are also connected to a control valve (not shown) so that the hydraulic fluid may be supplied to some other actuator (not shown). The circuit portions thereof, however, are omitted.

The first hydraulic pump 1 and the second hydraulic pump are of the variable displacement type, and are respectively equipped with regulators 1*a* and 2*a* which are delivery flow rate adjustment means. The regulators 1*a* and 2*a* are controlled by a control signal from a controller 21 (described below), whereby the tilting angles (volumes) of the first and second hydraulic pumps 1 and 2 are controlled, and the delivery flow rate is controlled.

In a first main line 31 supplying the hydraulic fluid delivered from the first hydraulic pump to the boom cylinder 6 and the arm cylinder 7, there are arranged in series from the upstream side the control valve 3 and the discharge valve 4. In a second main line 32 supplying the hydraulic fluid delivered from the second hydraulic pump 2 to the boom cylinder 6, there is arranged the return hydraulic fluid selection valve 5. In the first main line 31, there is provided a pressure sensor 18 as a second pressure detection device detecting the pressure of the hydraulic fluid delivered by the first hydraulic pump. A delivery pressure signal of the first hydraulic pump detected by the pressure sensor 18 is inputted to the controller 21.

The control valve 3 is a 3-position/6-port switching control valve. By a pilot pressure supplied to both operation portions 3*x* and 3*y* thereof, the control valve position is switched to vary the opening area of the hydraulic working fluid passage. Through this operation, the direction and flow rate of the hydraulic working fluid supplied from the first hydraulic pump 1 to the arm cylinder 7 are controlled to drive the arm cylinder 7. The control valve 3 has an inlet port 3*c* to which the hydraulic fluid from the first hydraulic pump 1 is supplied, an outlet port 3*d* communicating with the hydraulic working fluid tank 30, a center port 3T allowing communication when at a neutral position, and connection ports 3*a* and 3*b* connected to the arm cylinder 7 side. It is a center bypass type valve, which guides the hydraulic fluid from the first hydraulic pump 1 to the hydraulic working fluid tank 30 when at the neutral position. The line connecting the first main line 31 and the inlet port 3*c* is provided with a check valve 15 preventing back flow to the first hydraulic pump 1.

The discharge valve 4 is a 3-position/7-port switching control valve, and the return hydraulic fluid selection valve 5 is a 3-position/6-port switching control valve. By the pilot pressure supplied to both operation portions 4*x* and 5*x*, and 4*y* and 5*y*, the control valve positions are switched, and the opening areas of the hydraulic lines of the hydraulic working fluid are varied. More specifically, when the pilot pressure is supplied to the operation portions 4*y* and 5*y*, the discharge valve 4 moves to the left, and the return hydraulic fluid selection valve 5 moves to the right, with each valve being switched to the position A. Conversely, when the pilot pressure is supplied to the operation portions 4*x* and 5*x*, the discharge valve 4 moves to the right, and the return hydraulic fluid selection valve 5 moves to the left, with each valve being switched to the position B. Through these operations, the direction and flow rate of the hydraulic working fluid supplied to the boom cylinder 6 from at least one of the first hydraulic pump 1 and the second hydraulic pump 2 are controlled to drive the boom cylinder 6.

The return hydraulic fluid selection valve 5 has an inlet port 5*c* to which the hydraulic fluid from the second hydraulic pump 2 is supplied, a connection port 5*d* communicating with a communication line 23 described below, a center port 5T communicating when at the neutral position, and connection ports 5*a* and 5*b* connected to the boom cylinder 6 side. It is a center bypass type valve, which guides the hydraulic fluid from the second hydraulic pump 2 to the hydraulic working fluid tank 30 when at the neutral position. The line connecting the second main line 32 and the inlet port 5*c* is provided with a check valve 12 preventing back flow to the second hydraulic pump 2. The inner hydraulic line establishing communication from the connection port 5*a* to the connection port 5*d* when the return hydraulic fluid selection valve 5 is at the position A is provided with a restrictor.

The discharge valve 4 has an inlet port 4*c* to which the hydraulic fluid from the first hydraulic pump 1 is supplied, an outlet port 4*d* communicating with the hydraulic working fluid tank 30, a connection port 4*e* communicating with a communication line 23 described below, a center port 4T communicating when at the neutral position, and connection ports 4*a* and 4*b* connected to the boom cylinder 6 side. It is a center bypass type valve, which guides the hydraulic fluid from the first hydraulic pump 1 to the hydraulic working fluid tank 30 when at the neutral position. The line connecting the first main line 31 and the inlet port 4*c* is provided with a check valve 13 preventing back flow to the first hydraulic pump 1. A restrictor is provided in the inner hydraulic line establishing communication from the connection port 4*e* to the connection port 4*a* when the discharge valve 4 is at the position A. Further, one end side of the communication line 23 is connected to the connection port 4*e*, and the connection port 5*d* of the return hydraulic fluid selection valve 5 is connected to the other end side of the communication line 23 via the regeneration control valve 8.

The boom cylinder 6 has a cylinder and a piston rod, and the cylinder is equipped with a bottom side hydraulic fluid chamber 6*a* and the rod side hydraulic fluid chamber 6*b*. One end side of the first line 33 is connected to the bottom side hydraulic fluid chamber 6*a*, and the other end side of the first line 33 is connected to the connection port 4*a* of the discharge valve 4 and to the connection port 5*a* of the return hydraulic fluid selection valve 5. One end side of the second line 34 is connected to the rod side hydraulic fluid chamber 6*b*, and the other end side of the second line 34 is connected to the connection port 4*b* of the discharge valve 4 and to the connection port 5*b* of the return hydraulic fluid selection valve 5. The first line 33 is provided with a pressure sensor 17 as a first pressure detection device detecting the pressure of the bottom side hydraulic fluid chamber 6*a* of the boom cylinder 6. The pressure signal of the boom cylinder bottom side hydraulic fluid chamber 6*a* detected by the pressure sensor 17 is inputted to the controller 21.

The arm cylinder 7 has a cylinder and a piston rod, and the cylinder is equipped with a bottom side hydraulic fluid chamber 7*a* and a rod side hydraulic fluid chamber 7*b*. One end side of the third line 35 is connected to the bottom side hydraulic fluid chamber 7*a*, and the other end side of the third line 35 is connected to the connection port 3*a* of the control valve 3. One end side of the fourth line 36 is connected to the rod side hydraulic fluid chamber 7*b*, and the other end side of the fourth line 36 is connected to the connection port 3*b* of the control valve 3.

The communication line 23 as the discharge line discharges the return hydraulic fluid from the bottom side hydraulic fluid chamber 6*a* of the boom cylinder 6 to the hydraulic working fluid tank 30 from the return hydraulic fluid selection valve 5 via the discharge valve 4. At the intermediate portion of the communication line 23, there is provided a regeneration control valve 8 switching between the discharge and regeneration of the return hydraulic fluid. The regeneration control valve 8 is 2-position/3-port solenoid proportional valve, and is equipped with an operation portion receiving a command from the controller 21, a spool portion, and a spring portion. Connected to two ports (one outlet port and an inlet port) of the regeneration control valve 8 is the communication line 23, and one end side of a regeneration line 24 is connected to one port thereof (the other outlet port). The other end side of the regeneration line 24 is connected to the inlet port 3*c* of the control valve 3 via the check valve 16 solely allowing outflow from the regeneration line 24.

When there is no command signal from the controller 21, the regeneration control valve 8 places the spool at the communicating position by a spring. Since the communication line 23 establishes communication, the return hydraulic fluid from the boom cylinder 6 is supplied to the discharge valve 4 and can be discharged to the hydraulic working fluid tank 30. On the other hand, by moving the spool by a command signal from the controller 21, the amount of the return hydraulic fluid discharged to the hydraulic working fluid tank 30 is reduced, and the regeneration flow rate supplied to the control valve 3 via the regeneration line 24 is adjusted.

The first operation device 9 is equipped with an operation lever and a pilot valve 9*a*, and the pilot valve 9*a* generates a pilot pressure in accordance with the operation amount of the operation lever tilting operation. From the first operation device 9, there extends a pilot line indicated by a dashed line, and is connected to the operation portions 4*x*, 4*y*, 5*x*, and 5*y* of the discharge valve 4 and the return hydraulic fluid selection valve 5. When the operation lever is operated to the boom raising side, there is generated a boom raising pilot pressure Pu in accordance with the operation amount of the operation lever. This boom raising pilot pressure Pu is supplied to the operation portion 4*x* of the discharge valve 4 and to the operation portion 5*x* of the return hydraulic fluid selection valve 5. In accordance with this pilot pressure, the discharge valve 4 is switched to the boom raising direction (the position on the left-hand side as seen in the drawing), and the return hydraulic fluid selection valve 5 is switched to the boom raising direction (the position on the right-hand side as seen in the drawing). Similarly, when the operation lever is operated to the boom lowering side, there is generated a boom lowering pilot pressure Pd in accordance with the operation amount of the operation lever. This boom lowering pilot pressure Pd is supplied to the operation portion 4*y* of the discharge valve 4 and to the operation portion 5*y* of the return hydraulic fluid selection valve 5. In accordance with this pilot pressure, the discharge valve 4 is switched to the boom lowering direction (the position on the right-hand side as seen in the drawing), and the return hydraulic fluid selection valve 5 is switched to the boom lowering direction (the position on the left-hand side as seen in the drawing).

The second operation device 10 is equipped with an operation lever and a pilot valve 10*a*, and the pilot valve 10*a* generates a pilot pressure in accordance with the operation amount of the operation lever tilting operation. From the second operation device 10, there extends a pilot line indicated by a dashed line, and is connected to the operation portions 3*x* and 3*y* of the control valve 3. When the operation lever is operated to the crowding side, there is generated a crowding pilot pressure Pc in accordance with the operation amount of the operation lever. This crowding pilot pressure Pc is supplied to the operation portion 3*x* of the control valve 3, and, in accordance with this pilot pressure, the control valve 3 is switched to the crowding direction (the position on the left-hand side as seen in the drawing). Similarly, when the operation lever is operated to the dumping side, there is generated a dumping pilot pressure Pd in accordance with the operation amount of the operation lever. This dumping pilot pressure Pd is supplied to the operation portion 3*y* of the control valve 3, and, in accordance with this pilot pressure, the control valve 3 is switched to the dumping direction (the position on the right-hand side as seen in the drawing).

The boom lowering pilot line and the boom raising pilot line are provided with a pressure sensor 19 detecting the boom lowering pilot pressure Pd and a pressure sensor 25 detecting the boom raising pressure Pu. The pressure signals detected by these pressure sensors 19 and 25 are inputted to the controller 21. Similarly, the arm crowding pilot line and the arm dumping pilot line are provided with a pressure sensor 26 detecting the arm crowding pilot pressure Pc and a pressure sensor 20 detecting the arm dumping pilot pressure Pd. The pressure signals detected by these pressure sensors 26 and 20 are inputted to the controller 21.

The controller 21 inputs detection signals 118, 119, 120, 125, and 126 from the pressure sensors 18, 19, 20, 25, and 26, and performs a predetermined computation based on these signals, outputting a control command to the regeneration control valve 8.

It is noted here that the pressure sensor 19 and the pressure sensor 25 are first operation amount sensors capable of detecting the operation amount of the first operation device 9, and the pressure sensor 26 and the pressure sensor 20 are second operation amount sensors capable of detecting the operation amount of the second operation device 10.

The regeneration control valve 8 is operated by a control command from the controller 21. More specifically, its stroke is controlled by an electric signal supplied to the operation portion, so that the opening degree (opening area) is controlled.

Figure 3:
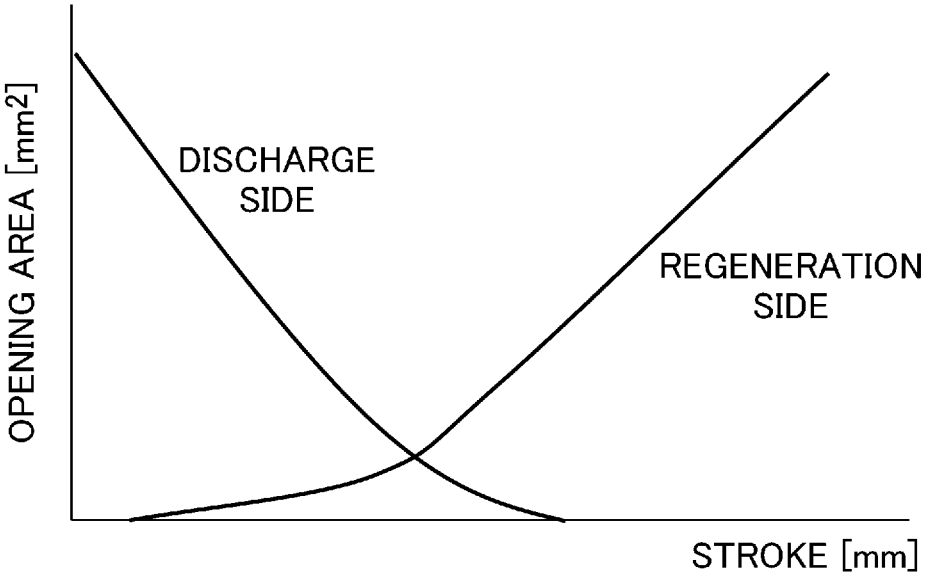
FIG. 3 is a characteristic diagram illustrating the opening area characteristic of a regeneration control valve constituting the construction machine according to the first embodiment of the present invention.

FIG. 3 is a characteristic diagram illustrating the opening area characteristic of the regeneration control valve constituting the construction machine according to the first embodiment of the present invention. The horizontal axis in FIG. 3 indicates the spool stroke of the regeneration control valve 8, and the vertical axis indicates the opening area thereof.

In FIG. 3, when the spool stroke is minimum (when it is at the normal position), the discharge side passage is open and the opening area is maximum, while the regeneration side passage is closed and the opening area is zero. When the stroke is gradually increased, the opening area of the discharge side passage is gradually reduced, and the regeneration side passage is opened, with the opening area gradually increasing. When the stroke is further increased, the discharge side passage is closed (the opening area is reduced to zero), and the opening area of the regeneration side passage is further increased. As a result of this construction, when the spool stroke is minimum, the hydraulic fluid discharged from the boom cylinder 6 is not regenerated, and the total amount flows to the discharge valve 4 side. When the stroke is gradually moved upwards, a portion of the hydraulic fluid discharged from the boom cylinder 6 flows into the regeneration line 24. Further, the opening area of the discharge side passage and that of the regeneration line 24 can be varied by adjusting the stroke, so that the regeneration flow rate can be controlled.

In the present embodiment, a regeneration/discharge flow rate adjustment device which makes it possible to adjust the flow rate of the hydraulic fluid flowing through the regeneration line 24 and the flow rate of the hydraulic fluid flowing through the communication line 23 as the discharge line connected to the hydraulic working fluid tank 30 is constituted by the discharge valve 4, the return hydraulic fluid selection valve 5, and the regeneration control valve 8.

Next, an operation of the construction machine according to the aforementioned first embodiment of the present invention will be described. First, the boom raising operation by the operator will be described.

In FIG. 2, when the boom raising operation is conducted by the operation lever of the first operation device 9, the boom raising pilot pressure Pu generated by the pilot valve 9*a* is supplied to the operation portion 4*x* of the discharge valve 4 and the operation portion 5*x* of the return hydraulic fluid selection valve 5. Accordingly, the discharge valve 4 moves to the right, and the return hydraulic fluid selection valve 5 moves to the left, with each valve being switched to the position B.

As a result, the hydraulic fluid from the first hydraulic pump 1 is supplied from the inlet port 4*c* of the discharge valve 4 to the bottom side hydraulic fluid chamber 6*a* of the boom cylinder 6 via the inner hydraulic line, the connection port 4*a*, and the first line 33. The hydraulic fluid from the second hydraulic pump 2 is supplied from the inlet port 5*c* of the return hydraulic fluid selection valve 5 to the bottom side hydraulic fluid chamber 6*a* of the boom cylinder 6 via the inner hydraulic line, the connection port 5*a*, and the first line 33.

On the other hand, the return hydraulic fluid discharged from the rod side hydraulic fluid chamber 6*b* of the boom cylinder 6 flows into the communication line 23 via the second line 34, the connection port 5*b* of the return hydraulic fluid selection valve 5, the inner hydraulic line, and the connection port 5*d*. The hydraulic fluid having flowed in is discharged from the connection port 4*e* of the discharge valve 4 to the hydraulic working fluid tank 30 via a restrictor provided in the inner hydraulic line and the outlet port 4*d*. In this way, the hydraulic fluid from the first hydraulic pump 1 and the second hydraulic pump 2 flows into the bottom side hydraulic fluid chamber 6*a* of the boom cylinder 6, and, at the same time, the hydraulic fluid in the rod side hydraulic fluid chamber 6*b* is discharged to the hydraulic working fluid tank 30 via the return hydraulic fluid selection valve 5 and the discharge valve 4. As a result, the piston rod of the boom cylinder 6 expands, and the boom moves in the raising direction.

Next, the arm crowding operation by the operator will be described.

In FIG. 2, when the arm crowding operation is conducted by the operation lever of the second operation device 10, the arm crowding pilot pressure Pc generated from the pilot valve 10*a* is supplied to the operation portion 3*x* of the control valve 3. Through this operation, the control valve 3 moves to the right, and is switched to the position B.

As a result, the hydraulic fluid from the first hydraulic pump 1 is supplied from the inlet port 3*c* of the control valve 3 to the bottom side hydraulic fluid chamber 7*a* of the arm cylinder 7 via the inner hydraulic line, the connection port 3*a*, and the third line 35.

On the other hand, the return hydraulic fluid discharged from the rod side hydraulic fluid chamber 7*b* of the arm cylinder 7 is discharged to the hydraulic working fluid tank 30 via the fourth line 36, the connection port 3*b* of the control valve 3, the inner hydraulic line, and the outlet port 3*d*. In this way, the hydraulic fluid from the first hydraulic pump 1 flows into the bottom side hydraulic fluid chamber 7*a* of the arm cylinder 7, and, at the same time, the hydraulic fluid in the rod side hydraulic fluid chamber 7*b* is discharged to the hydraulic working fluid tank 30 via the control valve 3. As a result, the piston rod of the arm cylinder 7 expands, and the arm moves in the crowding direction.

Next, described will be the operation in which the boom raising operation and the arm crowding operation are simultaneously conducted by the operator and in which the return hydraulic fluid from the boom cylinder 6 is regenerated in the arm cylinder 7. When regenerating the return hydraulic fluid from the boom cylinder 6 in the arm cylinder 7, in addition to the boom raising operation and the arm crowding operation described above, the regeneration control valve 8 is controlled by the controller 21. The operation of the first hydraulic pump 1, the second hydraulic pump 2, the control valve 3, the discharge valve 4, and the return hydraulic fluid selection valve 5 is the same as that described above, so a detailed description thereof will be omitted.

When the boom raising operation is performed by the operation lever of the first operation device 9, the boom raising pilot pressure Pu generated from the pilot valve 9*a* is detected by the pressure sensor 25, and is inputted to the controller 21. When the arm crowding operation is performed by the operation lever of the second operation device 10, the arm crowding pilot pressure Pc generated from the pilot valve 10*a* is detected by the pressure sensor 26, and is inputted to the controller 21. The delivery pressure of the first hydraulic pump 1 is detected by the pressure sensor 18, and is inputted to the controller 21.

Based on the input signals, the controller 21 calculates a command signal to the regeneration control valve 8, and controls the opening degree stroke of the regeneration control valve 8. By controlling the opening stroke of the regeneration control valve 8, the return hydraulic fluid discharged from the rod side hydraulic fluid chamber 6*b* of the boom cylinder 6 and having flowed into the communication line 23 from the connection port 5*b* of the return hydraulic fluid selection valve 5 via the inner hydraulic line and the connection port 5*d* flows into the regeneration line 24 via the regeneration control valve 8. The return hydraulic fluid having flowed into the regeneration line 24 flows into the inlet port 3*c* of the control valve 3 via the check valve 16. As a result, the return hydraulic fluid from the boom cylinder 6 having flowed into the communication line 23 flows to the delivery side of the first hydraulic pump via the regeneration control valve 8, and is regenerated in the arm cylinder 7 via the control valve 3. The return hydraulic fluid of the boom cylinder 6 is regenerated in the bottom side hydraulic fluid chamber 7*a* of the arm cylinder 7, so that the arm cylinder 7 can be operated efficiently.

Next, the boom lowering operation by the operator will be described.

In FIG. 2, when the boom lowering operation is conducted by the operation lever of the first operation device 9, the boom lowering pilot pressure Pd generated by the pilot valve 9*a* is supplied to the operation portion 4*y* of the discharge valve 4 and the operation portion 5*y* of the return hydraulic fluid selection valve 5. Accordingly, the discharge valve 4 moves to the left, and the return hydraulic fluid selection valve 5 moves to the right, with each valve being switched to the position A.

As a result, the hydraulic fluid from the first hydraulic pump 1 is supplied from the inlet port 4*c* of the discharge valve 4 to the rod side hydraulic fluid chamber 6*b* of the boom cylinder 6 via the inner hydraulic line, the connection port 4*b*, and the second line 34. The hydraulic fluid from the second hydraulic pump 2 is supplied from the inlet port 5*c* of the return hydraulic fluid selection valve 5 to the rod side hydraulic fluid chamber 6*b* of the boom cylinder 6 via the inner hydraulic line, the connection port 5*b*, and the second line 34.

On the other hand, the return hydraulic fluid discharged from the bottom side hydraulic fluid chamber 6*a* of the boom cylinder 6 flows into the communication line 23 via the first line 33, the connection port 5*a* of the return hydraulic fluid selection valve 5, the inner hydraulic line, and the connection port 5*d*. The hydraulic fluid having flowed in is discharged from the connection port 4*e* of the discharge valve 4 to the hydraulic working fluid tank 30 via a restrictor provided in the inner hydraulic line and the outlet port 4*d*. In this way, the hydraulic fluid from the first hydraulic pump 1 and the second hydraulic pump 2 flows into the rod side hydraulic fluid chamber 6*b* of the boom cylinder 6, and, at the same time, the hydraulic fluid in the bottom side hydraulic fluid chamber 6*a* is discharged to the hydraulic working fluid tank 30 via the return hydraulic fluid selection valve 5 and the discharge valve 4. As a result, the piston rod of the boom cylinder 6 contracts, and the boom moves in the lowering direction.

Next, the arm dumping operation by the operator will be described.

In FIG. 2, when the arm dumping operation is conducted by the operation lever of the second operation device 10, the arm dumping pilot pressure Pd generated from the pilot valve 10*a* is supplied to the operation portion 3*y* of the control valve 3. Through this operation, the control valve 3 moves to the left, and is switched to the position A.

As a result, the hydraulic fluid from the first hydraulic pump 1 is supplied from the inlet port 3*c* of the control valve 3 to the rod side hydraulic fluid chamber 7*b* of the arm cylinder 7 via the inner hydraulic line, the connection port 3*b*, and the fourth line 36.

On the other hand, the return hydraulic fluid discharged from the bottom side hydraulic fluid chamber 7*a* of the arm cylinder 7 is discharged to the hydraulic working fluid tank 30 via the third line 35, the connection port 3*a* of the control valve 3, the inner hydraulic line, and the outlet port 3*d*. In this way, the hydraulic fluid from the first hydraulic pump 1 flows into the rod side hydraulic fluid chamber 7*b* of the arm cylinder 7, and, at the same time, the hydraulic fluid in the bottom side hydraulic fluid chamber 7*a* is discharged to the hydraulic working fluid tank 30 via the control valve 3. As a result, the piston rod of the arm cylinder 7 contracts, and the arm moves in the dumping direction.

Next, described will be the operation in which the boom lowering operation and the arm dumping operation are simultaneously conducted by the operator and in which the return hydraulic fluid from the boom cylinder 6 is regenerated in the arm cylinder 7. When regenerating the return hydraulic fluid from the boom cylinder 6 in the arm cylinder 7, in addition to the boom lowering operation and the arm dumping operation described above, the regeneration control valve 8 is controlled by the controller 21. The operation of the first hydraulic pump 1, the second hydraulic pump 2, the control valve 3, the discharge valve 4, and the return hydraulic fluid selection valve 5 is the same as that described above, so a detailed description thereof will be omitted.

When the boom lowering operation is performed by the operation lever of the first operation device 9, the boom lowering pilot pressure Pd generated from the pilot valve 9*a* is detected by the pressure sensor 19, and is inputted to the controller 21. When the arm dumping operation is performed by the operation lever of the second operation device 10, the arm dumping pilot pressure Pd generated from the pilot valve 10*a* is detected by the pressure sensor 20, and is inputted to the controller 21. The delivery pressure of the first hydraulic pump 1 is detected by the pressure sensor 18, and inputted to the controller 21. Further, the pressure of the bottom side hydraulic fluid chamber 6*a* of the boom cylinder 6 is detected by the pressure sensor 17, and inputted to the controller 21.

Based on the input signals, the controller 21 calculates a command signal to the regeneration control valve 8, and controls the opening degree stroke of the regeneration control valve 8. By controlling the opening stroke of the regeneration control valve 8, the return hydraulic fluid discharged from the bottom side hydraulic fluid chamber 6*a* of the boom cylinder 6 having flowed into the communication line 23 from the connection port 5*a* of the return hydraulic fluid selection valve 5 via the connection port 5*d* flows into the regeneration line 24 via the regeneration control valve 8. The return hydraulic fluid, having flowed into the regeneration line 24, flows into the inlet port 3*c* of the control valve 3 via the check valve 16. As a result, the return hydraulic fluid from the boom cylinder 6 having flowed into the communication line 23 flows to the delivery side of the first hydraulic pump via the regeneration control valve 8, and is regenerated in the arm cylinder 7 via the control valve 3. The return hydraulic fluid of the boom cylinder 6 is regenerated in the rod side hydraulic fluid chamber 7*b* of the arm cylinder 7, so that the speed of the arm cylinder 7 can be increased. Further, the flow rate of the first hydraulic pump 1 can be suppressed by controlling the regulator 1*a* of the first hydraulic pump 1, so that the output power of the drive apparatus is suppressed, and energy saving can be achieved.

As described above, in the present embodiment, the regeneration/discharge flow rate adjustment device making it possible to control the return hydraulic fluid at the time of boom raising or of boom lowering on the regeneration side or on the discharge side can be constituted by minimum requisite three valves of the return hydraulic fluid selection valve 5, the regeneration control valve 8, and the discharge valve 4. Further, the flow rate on the regeneration side is adjustable by the regeneration control valve 8, and the flow rate on the discharge side is adjustable by the discharge valve 4, so that a satisfactory operability can be secured.

Figure 4:
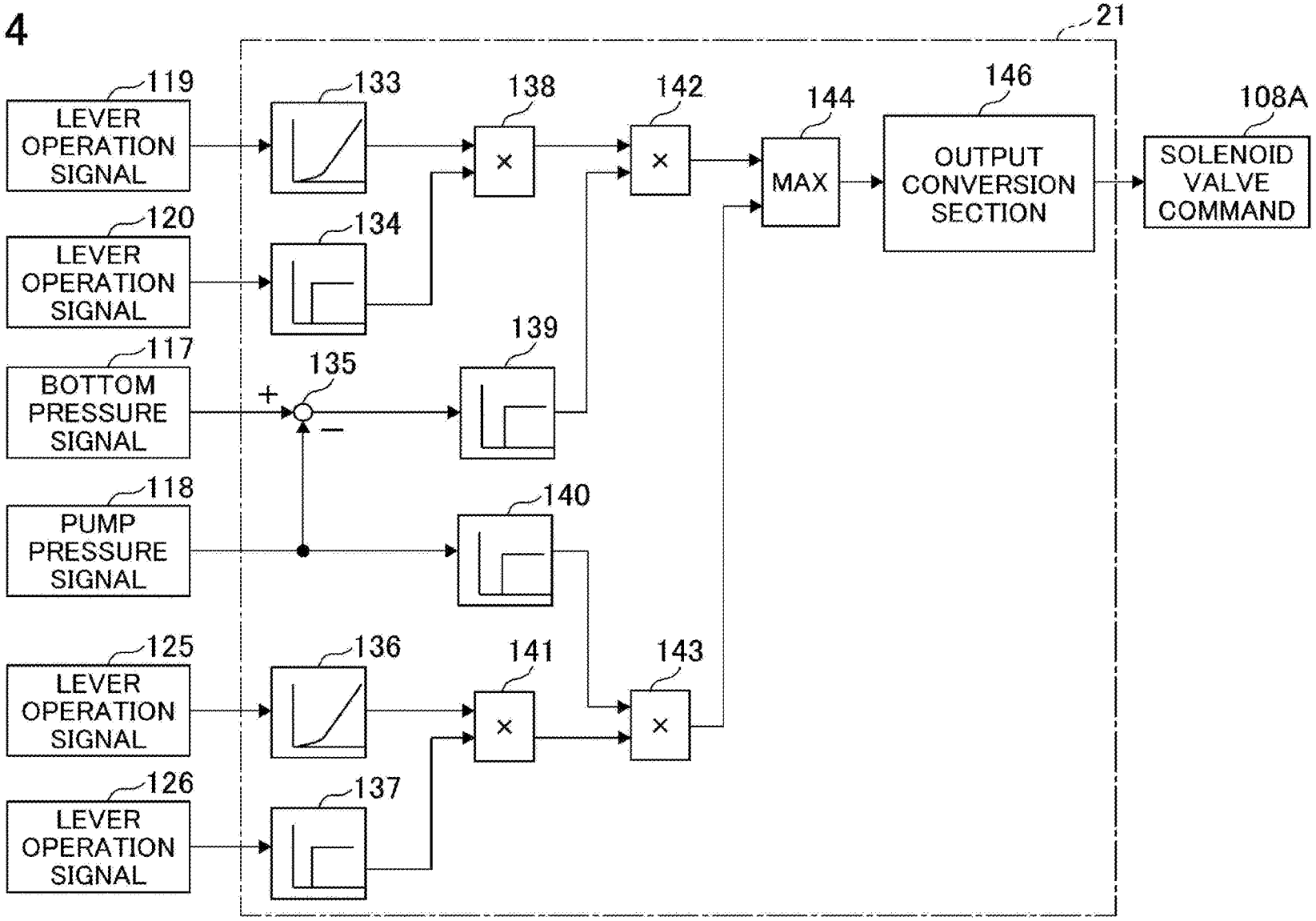
FIG. 4 is a block diagram illustrating a controller constituting the construction machine according to the first embodiment of the present invention.
Figure 5:
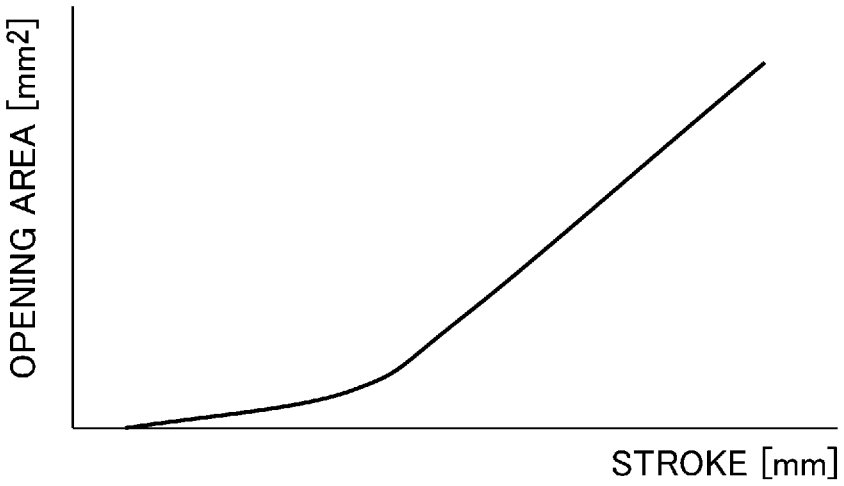
FIG. 5 is a characteristic diagram illustrating the opening area characteristic of a discharge valve constituting the construction machine according to the first embodiment of the present invention.

Next, a method of controlling the regeneration control valve 8 executed by the controller 21 will be described with reference to FIGS. 4 and 5. FIG. 4 is a block diagram illustrating a controller constituting the construction machine according to the first embodiment of the present invention, and FIG. 5 is a characteristic diagram illustrating the opening area characteristic of a discharge valve constituting the construction machine according to the first embodiment of the present invention. In FIGS. 4 and 5, the components that are the same as those in FIGS. 1 through 3 are indicated by the same reference numerals, and a detailed description thereof will be omitted.

As shown in FIG. 4, the controller 21 has a function generator 133, a function generator 134, a subtracter 135, a function generator 136, a function generator 137, a multiplier 138, a multiplier 138, a function generator 139, a function generator 140, a multiplier 141, a multiplier 142, a multiplier 143, a maximum value selector 144, and an output conversion section 146.

In FIG. 4, a detection signal 119 is a signal (lever operation signal) obtained through detection, by the pressure sensor 19, of the operation pilot pressure Pd in the boom lowering direction of the operation lever of the first operation device 9; a detection signal 120 is a signal (lever operation signal) obtained through detection, by the pressure sensor 20, of the operation pilot pressure Pd in the arm dumping direction of the operation lever of the second operation device 10; a detection signal 117 is a signal (bottom pressure signal) obtained through detection, by the pressure sensor 17, of the pressure in the bottom side hydraulic fluid chamber 6*a* (the pressure in the first line 33) of the boom cylinder 6; and a detection signal 118 is a signal (pump pressure) signal obtained through detection, by the pressure sensor 18, of the delivery pressure of the first hydraulic pump 1 (the pressure in the first main line 31). Further, a detection signal 125 is a signal (lever operation signal) obtained through detection, by the pressure sensor 25, of the operation pilot pressure Pu in the boom raising direction of the operation lever of the first operation device 9; and a detection signal 126 is a signal (lever operation signal) obtained through detection, by the pressure sensor 26, of the operation pilot pressure Pc in the arm crowding direction of the operation lever of the second operation device 10.

The function generator 133 calculates the opening area on the regeneration side of the regeneration control valve 8 in accordance with the boom lowering lever operation signal 119, and its characteristic is set based on the opening area characteristic of the regeneration control valve 8 shown in FIG. 3. The output of the function generator 133 is inputted to the multiplier 138. The horizontal axis in FIG. 3 indicates the spool stroke of the regeneration control valve 8, and the vertical axis indicates the opening area. In FIG. 3, when the spool stroke is minimum, the discharge side passage is open, and the opening area on the regeneration side is closed, so that no regeneration is effected. When the stroke is gradually increased, the opening area of the discharge side passage is gradually reduced, and the regeneration side passage is opened and the opening area is gradually increased, so that the hydraulic fluid discharged from the boom cylinder 6 flows into the regeneration line 24. Further, the opening area on the regeneration side can be varied by adjusting the stroke, so that the regeneration flow rate can be controlled.

In other words, in the case where the boom lowering lever operation signal 119 is large, control is effected such that the stroke of the regeneration control valve 8 is increased to enlarge the opening area on the regeneration side, causing the regeneration flow rate to be high. It is desirable to adjust the table of the function generator 133 such that the flow rate of the return hydraulic fluid discharged from the bottom side hydraulic fluid chamber 6*a* of the boom cylinder 6 is equivalent to that in the case where no regeneration is effected.

Referring back to FIG. 4, the function generator 134 calculates the coefficient used in the multiplier in accordance with the arm dumping lever operation signal 120. The function generator 134 outputs 0 as the minimum value while the lever operation signal 120 ranges from 0 to a previously set value, and outputs 1 as the maximum value when the lever operation signal exceeds the set value. The output of the function generator 134 is inputted to the multiplier 138.

The multiplier 138 inputs the opening area calculated by the function generator 133 and the coefficient calculated by the function generator 134, and outputs the multiplication value as the opening area. The output of the multiplier 138 is inputted to the multiplier 142. Through this computation, even if the boom lowering lever operation signal 119 has been inputted, if the arm dumping lever operation signal 120 has not been inputted, the output from the multiplier 138 is 0, and the regeneration control valve 8 remains at the stroke 0. This computation is performed in order to prevent the supply destination for the return hydraulic fluid from being lost in the case where even though the boom lowering operation has been performed, the arm dumping operation has not been performed and where the control valve 3 is in the neutral state, and no regeneration can be performed.

The subtracter 135 inputs the bottom pressure signal 117 and the pump pressure signal 118, calculates the differential pressure, and outputs the differential pressure signal to the function generator 139.

The function generator 139 calculates the coefficient used by the multiplier in accordance with the differential pressure calculated by the subtracter 135. The function generator 139 outputs 0 as the minimum value while the differential pressure ranges from 0 to a previously set value, and outputs 1 as the maximum value when the differential pressure exceeds the set value. The output of the function generator 139 is inputted to the multiplier 142.

The multiplier 142 inputs the opening area calculated by the multiplier 138 and the coefficient calculated by the function generator 139, and outputs the multiplication value as the opening area. The output of the multiplier 142 is inputted to the maximum value selector 144. Through this computation, the opening area of the regeneration control valve 8 is calculated by the function generator 133 as follows: when the differential pressure is lower than the set value, it is determined that regeneration is impossible, and there is generated a signal setting the opening area on the regeneration side to 0. On the other hand, when the differential pressure is higher than the set value, it is determined that regeneration is possible, and computation is performed such that the opening area on the regeneration side equals to the value outputted from the function generator 133.

When the stroke of the regeneration control valve 8 is 0, the discharge side is totally open. The return hydraulic fluid is supplied to the discharge valve 4, and properly undergoes throttle control by the discharge valve 4. FIG. 5 shows the opening area characteristic of the discharge valve 4. In FIG. 5, the horizontal axis indicates the stroke of the discharge valve 4, and the vertical axis indicates the opening area. When the boom raising pilot pressure Pu or the boom lowering pilot pressure Pd is inputted to the operation portions 4*x* and 4*y* of the discharge valve 4, the stroke increases in accordance with the pilot pressure. Thus, this is of a characteristic in which the opening area increases as the pilot pressure rises, and the return hydraulic fluid having flowed into the discharge valve 4 undergoes proper throttle control in accordance with the lever operation amount. The discharge valve 4 has the two operation portions 4*x* and 4*y*, each of which independently allows characteristic setting.

Referring back to FIG. 4, the function generator 136 calculates the opening area on the regeneration side of the regeneration control valve 8 in accordance with the boom raising lever operation signal 125. In the case where the boom raising lever operation signal 125 is large, the stroke of the regeneration control valve 8 is increased to enlarge the opening area on the regeneration side, effecting control such that the regeneration flow rate is high. The output of the function generator 136 is inputted to the multiplier 141.

The function generator 137 calculates the coefficient used in the multiplier in accordance with the arm crowding lever operation signal 126. The function generator 137 outputs 0 as the minimum value while the lever operation signal 126 ranges from 0 to a previously set value, and outputs 1 as the maximum value when the lever operation signal exceeds the set value. The output of the function generator 137 is inputted to the multiplier 141.

The multiplier 141 inputs the opening area calculated by the function generator 136 and the coefficient calculated by the function generator 137, and outputs the multiplication value as the opening area. The output of the multiplier 141 is inputted to the multiplier 143. Through this computation, even if the boom raising lever operation signal 125 has been inputted, if the arm crowding lever operation signal 126 has not been inputted, the output from the multiplier 141 is 0, and the regeneration control valve 8 remains at the stroke 0. This computation is performed in order to prevent the supply destination for the return hydraulic fluid from being lost in the case where even though the boom raising operation has been performed, the arm crowding operation has not been performed and where the control valve 3 is in the neutral state, and no regeneration can be performed.

The function generator 140 calculates the coefficient used in the multiplier in accordance with the pump pressure signal 118. The function generator 140 outputs 0 as the minimum value while the pump pressure signal 118 ranges from 0 to a previously set value, and outputs 1 as the maximum value when the pump pressure signal 118 exceeds the set value. The output of the function generator 140 is inputted to the multiplier 143.

The multiplier 143 inputs the opening area calculated by the multiplier 141 and the coefficient calculated by the function generator 140, and outputs the multiplication value as the opening area. The output of the multiplier 143 is inputted to the maximum value selector 144. This computation is performed in order to regenerate the return hydraulic fluid of the rod side hydraulic fluid chamber 6*b* in the arm cylinder 7 solely when an excavation reaction force acts on the boom cylinder 6, and the rod side hydraulic fluid chamber 6*b* of the boom cylinder 6 attains high pressure. In the present embodiment, the determination of this excavation state is based on the pump pressure signal 118. Only when the pump pressure signal is of high pressure, control is performed so as to connect the regeneration control valve 8 to the regeneration line 24 in accordance with the output of the multiplier 141.

In the case of a low load work as in the case of leveling in the air, it is more desirable for the boom raising return hydraulic fluid to be discharged to the hydraulic working fluid tank 30 than to be regenerated in the arm cylinder 7. This helps to reduce the pressure loss and to improve efficiency. Thus, in the present embodiment, the function generator 140 outputs 0 when the pump pressure signal 118 is equal to or lower than the set value, the multiplier 143 outputs 0 independently of the output of the multiplier 141, and the regeneration control valve 8 is not controlled, whereby control is performed so as to guide the return hydraulic fluid to the discharge valve 4 and to reduce the unnecessary loss. The determination of the time of excavation may be based on the pressure signal of the bottom side hydraulic fluid chamber 7*a* of the arm cylinder 7 or the pressure signal of the rod side hydraulic fluid chamber 6*b* of the boom cylinder 6.

The maximum value selector 144 inputs the output of the multiplier 142 and the output of the multiplier 143, and outputs the maximum value of them. The output of the maximum value selector 144 is inputted to the output conversion section 146. Normally, in the present embodiment, one of the output of the multiplier 142 and the output of the multiplier 143 is always 0. This is due to the fact that the boom raising operation and the boom lowering operation cannot be performed simultaneously, and that one of the function generators 133 and 136 is always 0. This also applies to the relationship between the arm crowding operation and the arm dumping operation. The maximum value selector 144 calculates the requisite regeneration side opening area of the regeneration control valve 8 for the boom raising operation or the boom lowering operation.

The output conversion section 146 performs output conversion of the inputted regeneration side opening area of the regeneration control valve 8, and outputs it as a solenoid valve command 108A which is a control command to the regeneration control valve 8. Through this operation, the regeneration side opening area of the regeneration control valve 8 is controlled to a desired value.

Next, the operation of the controller 21 will be described.

When the lever operation signal 119 for the boom lowering operation is inputted, the function generator 133 calculates the regeneration side opening area signal of the regeneration control valve 8, and outputs it to the multiplier 138. When the lever operation signal 120 for the arm dumping operation is inputted, the function generator 134 outputs 1 to the multiplier 138 when the arm dumping operation is on and regeneration is possible. When regeneration is impossible, the function generator 134 outputs 0 to the multiplier 138. The multiplier 138 corrects the opening area signal of the regeneration control valve 8 outputted from the function generator 133, and outputs it to the multiplier 142.

The subtracter 135 inputs the bottom pressure signal 117 and the pump pressure signal 118, and calculate a differential pressure signal. The function generator 139 inputs the differential pressure signal, and determines whether or not regeneration is possible. When regeneration is possible, the function generator 139 outputs 1 to the multiplier 142, and when regeneration is impossible, it outputs 0 to the multiplier 142. The multiplier 142 corrects the opening area signal of the regeneration control valve 8 outputted from the function generator 133, and outputs it to the maximum value selector 144.

When the lever operation signal 125 for the boom raising operation is inputted, the function generator 136 calculates the regeneration side opening area signal of the regeneration control valve 8, and outputs it to the multiplier 141. When the lever operation signal 126 for the arm crowding operation is inputted, the function generator 137 outputs 1 to the multiplier 141 when the arm crowding operation is on and regeneration is possible. When regeneration is impossible, the function generator 137 outputs 0 to the multiplier 141. The multiplier 141 corrects the opening area signal of the regeneration control valve 8 outputted from the function generator 136, and outputs it to the multiplier 143.

The function generator 140 inputs the pump pressure signal 118, and determines whether or not the machine is in the excavating state. When the machine is in the excavating state, the function generator 140 outputs 1 to the multiplier 143, and when the machine is not in the excavating state, it outputs 0 to the multiplier 143. The multiplier 143 corrects the opening area signal of the regeneration control valve 8 outputted from the function generator 136, and outputs it to the maximum value selector 144.

The maximum value selector 144 calculates the requisite opening area on the regeneration side of the regeneration control valve 8 for the boom raising operation or the boom lowering operation, and outputs it to the output conversion section 146. The output conversion section 146 performs output conversion of the inputted opening area of the regeneration control valve 8, and outputs it as the solenoid valve command 108A which is a control command to the regeneration control valve 8. Accordingly, the opening area on the regeneration side of the regeneration control valve 8 can be controlled to a desired value.

Through the above operation, the return hydraulic fluid at the time of boom raising or boom lowering is properly throttle-controlled by the regeneration control valve 8 at the time of regeneration, and even when no regeneration is effected, is properly throttle-controlled by the discharge valve 4. This helps to secure a satisfactory operability. Further, the return hydraulic fluid at the time of boom raising or lowering can be regenerated while being properly flow-rate-controlled solely by the three valves of the regeneration control valve 8, the return hydraulic fluid selection valve 5, and the discharge valve 4, so that a satisfactory operability can be secured.

In the construction machine according to the first embodiment of the present invention described above, it is possible to regenerate the return hydraulic fluid at the time of both boom raising operation and boom lowering operation with a small number of valves, and to secure a satisfactory operability at the time of both boom raising operation and boom lowering operation.

In the present embodiment described above, the return hydraulic fluid at the time of boom raising operation is regenerated in the bottom side hydraulic fluid chamber 7*a* of the arm cylinder 7. This construction proves effective at the time of normal gravel loading operation or leveling operation of the hydraulic excavator. This, however, should not be construed restrictively. As needed, the present embodiment may be constructed such that the return hydraulic fluid at the time of boom raising operation is regenerated in the rod side hydraulic fluid chamber 7*b* of the arm cylinder 7 or in some other hydraulic actuator. Further, the present embodiment may be constructed such that the return hydraulic fluid at the time of boom lowering operation is regenerated in the bottom side hydraulic fluid chamber 7*a* of the arm cylinder 7 or in some other hydraulic actuator.

Further, in the present embodiment, the hydraulic fluid is supplied from the first hydraulic pump 1 which can supply the hydraulic fluid to the boom cylinder 6 and the arm cylinder 7 to the boom cylinder 6 via the discharge valve 4, and the hydraulic fluid is supplied from the second hydraulic pump 2 which can supply the hydraulic fluid to the boom cylinder 6 to the boom cylinder 6 via the return hydraulic fluid selection valve 5. This, however, should not be construed restrictively. For example, the hydraulic fluid may be supplied from the first hydraulic pump 1 to the boom cylinder 6 via the return hydraulic fluid selection valve 5, and may be supplied from the second hydraulic pump 2 to the boom cylinder 6 via the discharge valve 4. This makes it possible to realize, for example, a connection allowing easiest construction in the case where the valves are integrally produced.

Further, in the present embodiment, the controller 21 performs a control such that the differential pressure is computed based on the bottom pressure signal 117 and the pump pressure signal 118 and that when the differential pressure is equal to or lower than the set value, the regeneration at the time of boom lowering operation is not performed. However, such control is not required in the case of a construction machine in which the pressure of the return hydraulic fluid at the time of boom lowering operation is always higher than the pressure of the rod side hydraulic fluid chamber 7*b* of the arm cylinder 7.

Further, in the present embodiment, the controller 21 performs a control such that the pump pressure signal 118 is taken in and that when the pump pressure signal 118 is of a value equal to or lower than the set value, no regeneration is effected at the time of boom raising operation. This, however, is not indispensable. In a construction machine in which speed is of more importance than efficiency, there is no problem in terms of operation if regeneration is performed independently of the load. Further, in this case, the pressure sensor 18 is unnecessary, whereby the cost can be reduced.

[Embodiment 2]

Figure 6:
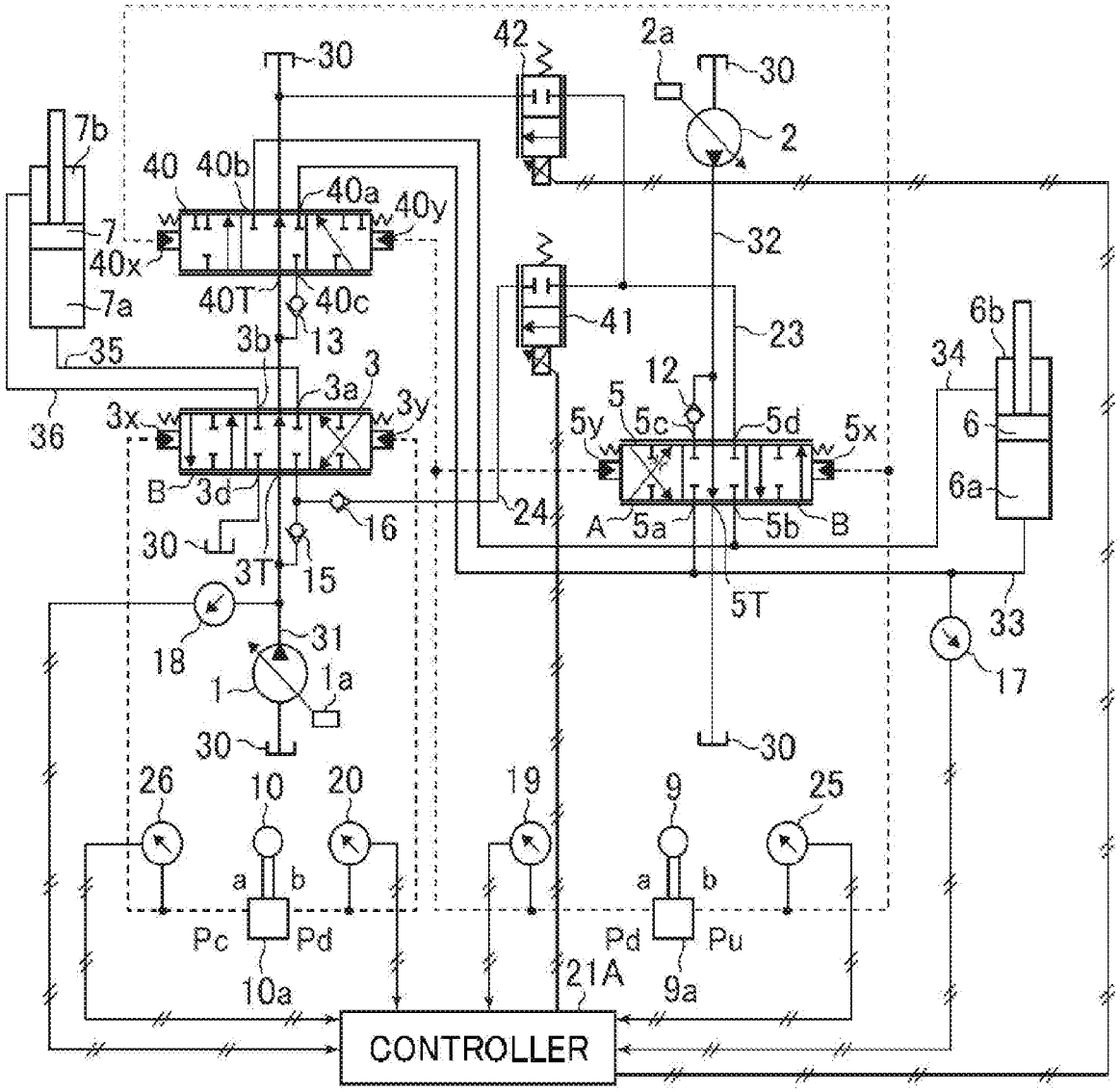
FIG. 6 is a schematic diagram illustrating a hydraulic drive system constituting a construction machine according to a second embodiment of the present invention.
Figure 7:
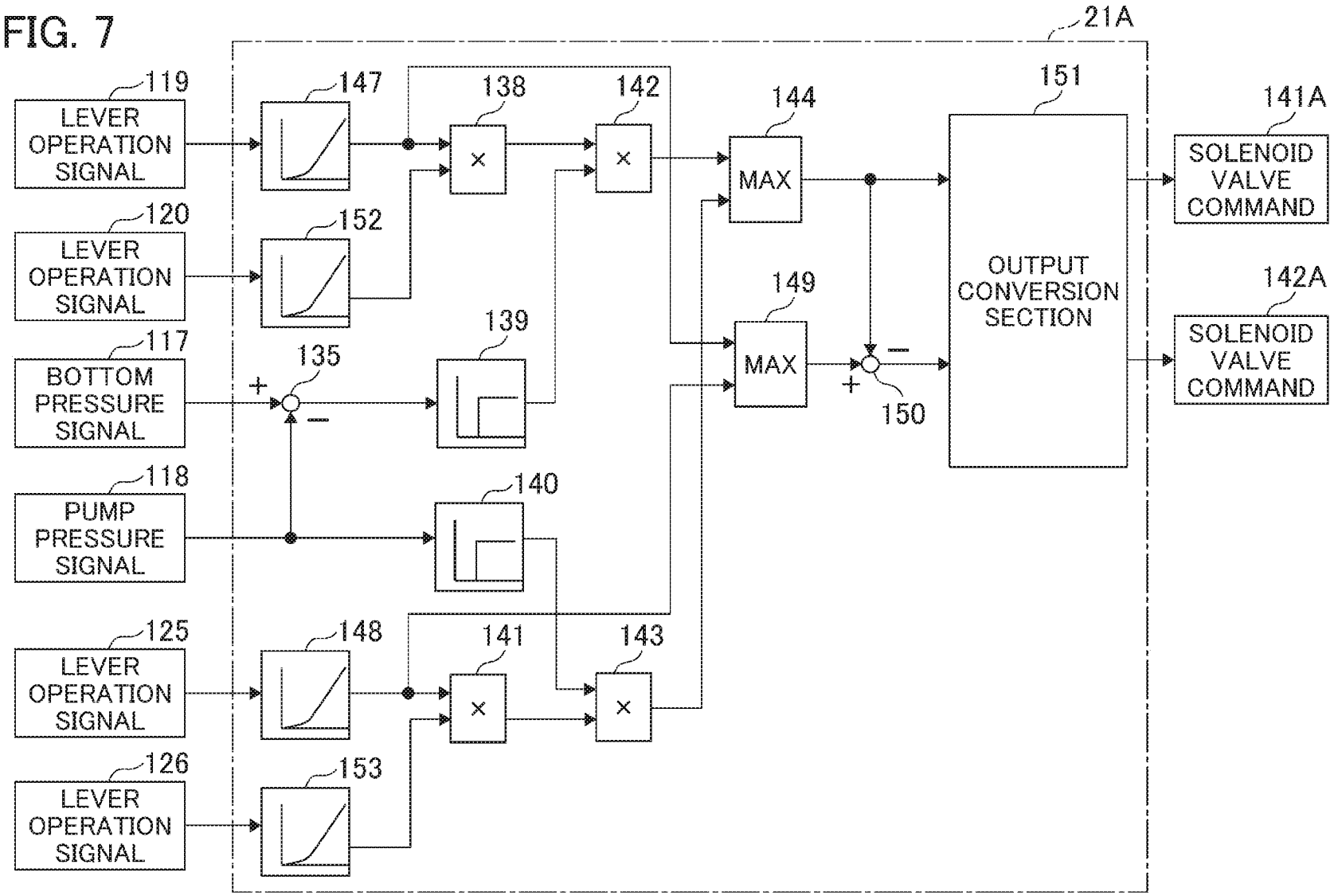
FIG. 7 is a block diagram illustrating a controller constituting the construction machine according to the second embodiment of the present invention.

In the following, the construction machine according to the second embodiment of the present invention will be described with reference to the drawings. FIG. 6 is a schematic diagram illustrating a hydraulic drive system constituting the construction machine according to the second embodiment of the present invention, and FIG. 7 is a block diagram illustrating a controller constituting the construction machine according to the second embodiment of the present invention. In FIGS. 6 and 7, the same components as those in FIGS. 1 through 5 are indicated by the same reference numerals, and a detailed description thereof will be omitted.

The hydraulic drive system of the construction machine according to the second embodiment is roughly the same as that of the first embodiment. The second embodiment differs from the first embodiment in that the regeneration control valve 8 is replaced by a regeneration valve 41 and a discharge valve 42 and that the discharge valve 4 is replaced by a second control valve 40. In the present embodiment, the regeneration control valve 8 of the first embodiment is replaced by the regeneration valve 41 and the discharge valve 42, the opening degree of each of which is controlled by a controller 21A, so that a finer flow rate control is possible. Further, the discharge valve 42 has the function of the discharge valve 4 in the first embodiment to control the return hydraulic fluid, so that the discharge valve 4 is replaced by the second control valve 40 solely having the function to switch-supply the hydraulic fluid of the first hydraulic pump 1 to the boom cylinder 6.

More specifically, as shown in FIG. 6, at an intermediate portion of the communication line 23, there is provided the discharge valve 42 which is a 2-position/2-port solenoid proportional valve capable of adjusting the flow rate of the return hydraulic fluid. Further, at an intermediate portion of the regeneration line 24, there is provided the regeneration valve 41 which is a 2-position/2-port solenoid proportional valve capable of adjusting the regeneration flow rate. In the portion of the communication line 23 between the discharge valve 42 and the return hydraulic fluid selection valve 5, there is provided a branching-off portion to which one end side of the regeneration line 24 is connected.

The second control valve 40 is a 3-position/6-port switch control valve. By the pilot pressure supplied to both pilot operation portions 40*x* and 40*y*, the control valve position is switched to vary the opening area of the flow passage of the hydraulic working fluid. Through this operation, the direction and the flow rate of the hydraulic working fluid supplied from the first hydraulic pump 1 to the boom cylinder 6 is controlled, and the boom cylinder 7 is driven. Further, the second control valve 40 has an inlet port 40*c* to which the hydraulic fluid from the first hydraulic pump 1 is supplied, a center port 40T allowing communication when at a neutral position, and connection ports 40*a* and 40*b* connected to the boom cylinder 6 side. It is a center bypass type valve, which guides the hydraulic fluid from the first hydraulic pump 1 to the hydraulic working fluid tank 30 when at the neutral position. The line connecting the first main line 31 and the inlet port 40*c* is provided with a check valve 13 preventing back flow to the first hydraulic pump 1.

Next, a method of controlling the regeneration valve 41 and the discharge valve 42 executed by the controller 21A according to the present embodiment will be described with reference to FIG. 7.

As shown in FIG. 7, the construction of the controller 21A of the present embodiment differs from the construction of the controller 21 of the first embodiment in the following points.

(a) The function generators 133 and 136 which input the lever operation signal 119 as the boom lowering operation amount and the lever operation signal 125 as the boom raising operation amount are replaced by function generators 147 and 148. Further, the function generators 134 and 137 which input the lever operation signal 120 as the arm dumping operation amount and the lever operation signal 126 as the arm crowding operation amount are replaced by function generators 152 and 153.

(b) There are added: a second maximum value selector 149 which inputs the output of the function generator 147 and the output of the function generator 148 and selects the maximum value; a second subtracter 150 which subtracts the output of the maximum value selector 144 from the output of the second maximum value selector 149; and an output conversion section 151 which inputs the output of the maximum value selector 144 and the output of the second subtracter 150 and outputs a solenoid valve command 141A as a command for the regeneration valve 41 and a solenoid valve command 142A as a command for the discharge valve 42.

In the present embodiment, the function generator 147 and the function generator 148 calculate the discharge side opening area signal throttle-controlled in the case where no regeneration is effected. That is, there is calculated an opening area that is equal to the opening area of the discharge valve 4 in the first embodiment. Opening area signals outputted from the function generator 147 and the function generator 148 are referred to as target opening area signals.

The function generator 152 calculates a coefficient used by the multiplier in accordance with the lever operation signal 120 which is the arm dumping operation amount. The function generator 152 outputs 0 as the minimum value when the lever operation signal 120 is 0, and increases the output as the lever operation signal 120 rises, outputting 1 as the maximum value. The value outputted from the function generator 152 is outputted to the multiplier 138, and corrects the target opening area.

The function generator 153 calculates a coefficient used by the multiplier in accordance with the lever operation signal 126 which is the arm crowding operation amount. The function generator 153 outputs 0 as the minimum value when the lever operation signal 126 is 0, and increases the output as the lever operation signal 126 rises, outputting 1 as the maximum value. The value outputted from the function generator 153 is outputted to the multiplier 141, and corrects the target opening area.

As compared with the ON/OFF-basis control of the first embodiment, in which it is determined whether or not the regeneration is possible, the computation using the outputs of the function generator 152 and the function generator 153 makes it possible to perform a finer control in accordance with the arm operation.

The target opening area signal corrected by the multiplier 138, the multiplier 142, the multiplier 141, and the multiplier 143 is outputted to the regeneration valve 41 as the solenoid valve command 141A via the maximum value selector 144 and the output conversion section 151. Accordingly, the regeneration valve 41 is throttle-controlled so as to attain the target opening area as computed by the controller 21.

On the other hand, the second maximum value selector 149 selects the maximum value of the output of the function generator 147 and the output of the function generator 148, and outputs the opening area signal of the discharge valve 42 in the case where no regeneration is performed at the time of boom lowering or boom raising.

The second subtracter 150 subtracts the target opening area signal of the regeneration valve 41 which is the output of the maximum value selector 144 from the opening area signal of the discharge valve 42, which is the output of the second maximum value selector 149, in the case where no regeneration is performed at the time of boom lowering or boom raising, and calculates the result as the target opening area signal of the discharge valve 42, and outputs it to the discharge valve 42 as the solenoid valve command 142A via the output conversion section 151. Through this computation, the opening area of the discharge valve 42 is reduced by an amount corresponding to the opening area allowing flow to the regeneration side at the regeneration valve 41, whereby the discharge valve 42 is further throttled than in the case where no regeneration is effected. As a result, the return hydraulic fluid discharged to the hydraulic working fluid tank 30 is reduced, and the flow rate of the hydraulic fluid flowing to the regeneration side increases.

Further, in the case where the function generator 152 or the function generator 153 outputs 1, that is, in the case where the return hydraulic fluid can be regenerated in the arm cylinder 7 to the utmost degree, the target opening area signal calculated by the function generator 147 and the function generator 148 is input as it is to the second subtracter 150 via the maximum value selector 144, so that the output of the second subtracter 150 is 0. As a result, the discharge valve 42 is closed, so that all the return hydraulic fluid is regenerated.

Conversely, in the case where it is determined that regeneration is impossible and where the target opening area signal of the regeneration valve 41 is 0, the output of the second subtracter 150 remains as the output of the second maximum value selector 149. All the return hydraulic fluid is discharged to the hydraulic working fluid tank 30 via the discharge valve 42, and proper throttle control is performed with the opening area set by the function generator 147 and the function generator 148.

Through the above operation, in the present embodiment, the return hydraulic fluid at the time of boom raising or boom lowering is properly throttle-controlled by the regeneration valve 41 at the time of regeneration. Even when no regeneration is effected, throttle control is properly performed by the discharge valve 42. This helps to secure a satisfactory operability. Further, the return hydraulic fluid at the time of boom raising or boom lowering can be regenerated while properly performing the flow rate control solely with the three valves of the regeneration valve 41, the return hydraulic fluid selection valve 5, and the discharge valve 42, so that a satisfactory operability can be secured.

In the construction machine according to the second embodiment of the present invention described above, it is possible to attain the same effects as those of the first embodiment described above.

Further, in the construction machine according to the second embodiment of the present invention described above, the flow rate on the regeneration side and that on the discharge side can be independently controlled, so that finer adjustment is possible and a satisfactory operability can be secured.

[Embodiment 3]

Figure 8:
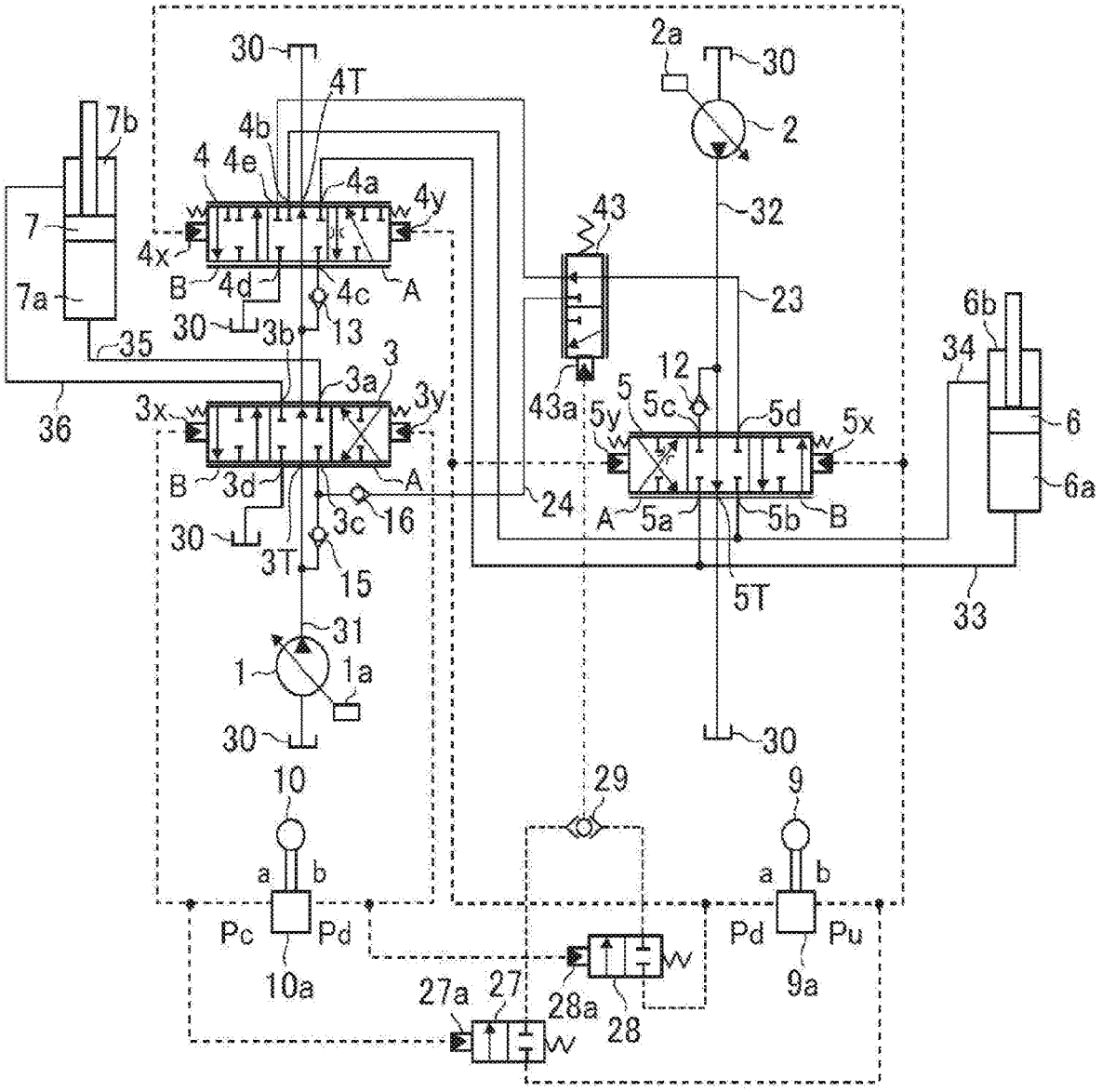
FIG. 8 is a schematic diagram illustrating a hydraulic drive system constituting a construction machine according to a third embodiment of the present invention.

In the following, the construction machine according to the third embodiment of the present invention will be described with reference to the drawings. FIG. 8 is a schematic diagram illustrating a hydraulic drive system constituting the construction machine according to the third embodiment of the present invention. In FIG. 8 the components that are the same as those in FIGS. 1 through 7 are indicated by the same reference numerals, and a detailed description thereof will be omitted.

In the construction machine according to the third embodiment of the present invention, the outline of the hydraulic drive system is roughly the same as that of the first embodiment. It differs from the first embodiment in that the controller 21, the pressure sensors 17, 18, 19, 20, 25, and 26, and the regeneration control valve 8 which is a solenoid proportional valve are omitted, and what is electrically controlled is all replaced with what operates hydraulically. As components corresponding to the pressure sensors and the controller 21, there are provided a first logic valve 27, a second logic valve 28, and a high pressure selection valve 29, and the regeneration control valve 8, which has been a solenoid proportional valve, is replaced by a hydraulically driven regeneration control valve 43.

More specifically, as shown in FIG. 8, there is provided at an intermediate portion of the communication line 23 the regeneration control valve 43 which switches between discharging and regeneration of the return hydraulic fluid. The regeneration control valve 43 is a 2-position/3-port control valve, and is equipped with an operation portion 43*a* receiving the pilot pressure from the high pressure selection valve 29, a spool portion, and a spring portion. In the regeneration control valve 43, the communication line 23 is connected to two ports (one outlet port and an inlet port), and one end side of the regeneration line 24 is connected to one port (the other outlet port).

The first logic valve 27 is a 2-position/2-port switch valve, and is equipped with an operation portion 27*a* to which the arm crowding pilot pressure Pc from a pilot valve 10*a* is supplied via a pilot hydraulic line, a spool portion, and a spring portion. To the inlet port of the first logic valve 27, there is supplied the boom raising pilot pressure Pu from the pilot valve 9*a* via the pilot hydraulic line, and the outlet port of the first logic valve 27 is connected to one input port of the high pressure selection valve 29 via the pilot hydraulic line.

The second logic valve 28 is a 2-position/2-port switch valve, and is equipped with an operation portion 28*a* to which the arm dumping pilot pressure Pd from the pilot valve 10*a* is supplied via the pilot hydraulic line, a spool portion, and a spring portion. To the inlet port of the second logic valve 28, there is supplied the boom lowering pilot pressure Pd from the pilot valve 9*a* via the pilot hydraulic line, and the outlet port of the second logic valve 28 is connected to the other input port of the high pressure selection valve 29 via the pilot hydraulic line.

The first logic valve 27 is closed at the normal position, and even if the boom raising pilot pressure Pu acts thereon, when the switching through the supply of the arm crowding pilot pressure Pc is not effected, the pilot pressure supplied to the high pressure selection valve 29, which is the output pressure of the logic valve, is 0. Conversely, even if the first logic valve 27 is switched by the arm crowding pilot pressure Pc, when the boom raising pilot pressure Pu is 0, the pilot pressure outputted from the first logic valve 27 is 0. That is, the first logic valve 27 outputs the pilot pressure when both the boom raising pilot pressure Pu and the arm crowding pilot pressure Pc are inputted. This means that when the boom raising operation and the arm crowding operation are on, there is outputted a signal switching the regeneration control valve 43 in order to regenerate the return hydraulic fluid at the time of boom raising operation in the bottom side hydraulic fluid chamber 7*a* of the arm cylinder 7.

Similarly to the first logic valve 27, the second logic valve 28 outputs the pilot pressure when both the boom lowering pilot pressure Pd from the pilot valve 9*a* and the arm dumping pilot pressure Pd from the pilot valve 10*a* are inputted. This means that when the boom lowering operation and the arm dumping operation are on, there is outputted a signal switching the regeneration control valve 43 in order to regenerate the return hydraulic fluid at the time of boom lowering operation in the rod side hydraulic fluid chamber 7*b* of the arm cylinder 7.

The pilot pressures outputted from the first logic valve 27 and the second logic valve 28 are supplied to the high pressure selection valve 29, and the higher of these pressures is supplied to the operation portion 43*a* of the regeneration control valve 43 to switch the regeneration control valve 43. In this case, the boom raising pilot pressure Pu and the boom lowering pilot pressure Pd are not outputted simultaneously, so that the first logic valve 27 and the second logic valve 28 do not output a pilot pressure simultaneously. That is, one of the control signal for regeneration at the time of boom-raising/arm-crowding and the control signal for regeneration at the time of boom-lowering/arm-dumping is inputted to the regeneration control valve 43. By switching the regeneration control valve 43, the return hydraulic fluid having flowed in the communication line 23 is regenerated in the arm cylinder 7 via the regeneration control valve 43.

In the present embodiment, the pressure of the bottom side hydraulic fluid chamber 6*a* of the boom cylinder 6 and the delivery pressure of the first hydraulic pump 1 are not detected, so that, as described in the first embodiment, the present embodiment is applicable to a construction machine in which the pressure of the return hydraulic fluid at the time of boom lowering operation is always higher than the pressure of the rod side hydraulic fluid chamber 7*b* of the arm cylinder 7, or a construction machine in which speed is of more importance than efficiency at the time of boom raising.

In the construction machine according to the third embodiment of the present invention described above, it is possible to attain the same effects as those of the first embodiment described above.

Further, in the construction machine according to the third embodiment of the present invention described above, the hydraulic drive apparatuses are all controlled hydraulically, whereby the cost can be reduced.

The present invention is not restricted to the above-described embodiments but includes various modifications. For example, the above embodiments, which have been described in detail to facilitate the understanding of the present invention, are not always restricted to ones equipped with all the components described above.

DESCRIPTION OF REFERENCE CHARACTERS

1: First hydraulic pump
2: Second hydraulic pump
3: Control valve
4: Discharge valve (regeneration/discharge flow rate adjustment device)
5: Return hydraulic fluid selection valve (regeneration/discharge flow rate adjustment device)
6: Boom cylinder
7: Arm cylinder
8: Regeneration control valve (regeneration/discharge flow rate adjustment device)
9: First operation device
10: Second operation device
12: Check valve
13: Check valve
14: Check valve
15: Check valve
16: Check valve
17: Pressure sensor
18: Pressure sensor
19: Pressure sensor
20: Pressure sensor
21: Controller
21A: Controller
23: Communication line (discharge line)
24: Regeneration line
25: Pressure sensor
26: Pressure sensor
27: First logic valve
28: Second logic valve
29: High pressure selection valve
30: Hydraulic working fluid tank
31: First main line
32: Second main line
33: First line
34: Second line
35: Third line
36: Fourth line
40: Second control valve
41: Regeneration valve (regeneration/discharge flow rate adjustment device)
42: Discharge valve (regeneration/discharge flow rate adjustment device)
43: Regeneration control valve (regeneration/discharge flow rate adjustment device)

The invention claimed is:

1. A construction machine comprising:

a first hydraulic actuator that is a hydraulic cylinder;

a second hydraulic actuator; a tank; and a first hydraulic pump supplying a hydraulic fluid to the second hydraulic actuator, the construction machine further comprising:

a return hydraulic fluid selection device that is connected to a bottom side hydraulic fluid chamber and a rod side hydraulic fluid chamber of the first hydraulic actuator via hydraulic lines, selects the rod side hydraulic fluid chamber as a supply source of a return hydraulic fluid at a time of a raising operation of the first hydraulic actuator, and selects the bottom side hydraulic fluid chamber as the supply source of the return hydraulic fluid at a time of a lowering operation of the first hydraulic actuator;

a regeneration line supplying the hydraulic fluid discharged from the return hydraulic fluid selection device to a portion between the second hydraulic actuator and the first hydraulic pump to regenerate the hydraulic fluid;

a discharge line discharging the hydraulic fluid discharged from the return hydraulic fluid selection device to the tank;

a regeneration/discharge flow rate adjustment device capable of adjusting a flow rate of the hydraulic fluid flowing through the regeneration line and a flow rate of the hydraulic fluid flowing through the discharge line; and a first operation device for operating the first hydraulic actuator in a raising direction or a lowering direction; a second operation device for operating the second hydraulic actuator; a first operation amount sensor capable of detecting an operation amount of the first operation device; and a second operation amount sensor capable of detecting an operation amount of the second operation device, wherein the return hydraulic fluid selection device controls the supply source and the discharge flow rate of the return hydraulic fluid in accordance with the operation amount of the first operation device; and the regeneration/discharge flow rate adjustment device controls the flow rate of the hydraulic fluid flowing through the regeneration line and the flow rate of the hydraulic fluid flowing through the discharge line in accordance with the respective operation amounts detected by the first operation amount sensor and the second operation amount sensor.

2. The construction machine according to claim 1, wherein the first operation device is a hydraulic pilot type operation device;

the regeneration/discharge flow rate adjustment device has a regeneration control valve capable of diverting or switching the hydraulic fluid discharged from the return hydraulic fluid selection device to the regeneration line and the discharge line, and a discharge valve provided on a downstream side of the regeneration control valve and capable of adjusting the flow rate of the hydraulic fluid discharged to the tank by a pilot pressure outputted from the first operation device; and the construction machine further comprises a controller that inputs the respective operation amount signals detected by the first operation amount sensor and the second operation amount sensor, and controls an opening degree of the regeneration control valve in accordance with these signals.

3. The construction machine according to claim 2, further comprising:

a first pressure sensor detecting a pressure of the return hydraulic fluid at the time of the lowering operation of the first hydraulic actuator; and a second pressure sensor detecting a pressure between the first hydraulic pump and the second hydraulic actuator, wherein the controller inputs a pressure signal of the return hydraulic fluid at the time of the lowering operation of the first hydraulic actuator detected by the first pressure sensor and a pressure signal between the first hydraulic pump and the second hydraulic actuator detected by the second pressure sensor, and controls the opening degree of the regeneration control valve in accordance with these signals.

4. The construction machine according to claim 2, further comprising:

a second hydraulic pump, wherein the discharge valve is provided with a hydraulic line for supplying the hydraulic fluid delivered from at least one of the first hydraulic pump and the second hydraulic pump to the first hydraulic actuator at the time of the raising operation of the first hydraulic actuator or the lowering operation thereof.

5. The construction machine according to claim 1, wherein the regeneration/discharge flow rate adjustment device has a regeneration valve regenerating the hydraulic fluid discharged from the return hydraulic fluid selection device in the regeneration line, and a discharge valve discharging the hydraulic fluid discharged from the return hydraulic fluid selection device to the tank; and the construction machine further comprises a controller that inputs the respective operation amount signals detected by the first operation amount sensor and the second operation amount sensor, and controls the opening degree of the regeneration valve and the opening degree of the discharge valve in accordance with these signals.

6. The construction machine according to claim 5, further comprising:

a first pressure sensor detecting a pressure of the return hydraulic fluid at the time of the lowering operation of the first hydraulic actuator; and a second pressure sensor detecting a pressure between the first hydraulic pump and the second hydraulic actuator, wherein the controller inputs a pressure signal of the return hydraulic fluid at the time of the lowering operation of the first hydraulic actuator detected by the first pressure sensor and a pressure signal between the first hydraulic pump and the second hydraulic actuator detected by the second pressure sensor, and controls the opening degree of the regeneration valve and the opening degree of the discharge valve in accordance with these signals.

7. The construction machine according to claim 1, further comprising:

a second hydraulic pump, wherein the return hydraulic fluid selection device is provided with a hydraulic line for supplying the hydraulic fluid delivered from at least one of the first hydraulic pump and the second hydraulic pump to the first hydraulic actuator at the time of the raising operation of the first hydraulic actuator or the lowering operation thereof.

8. A construction machine comprising:

a first hydraulic actuator that is a hydraulic cylinder;

a second hydraulic actuator; a tank; and a first hydraulic pump supplying a hydraulic fluid to the second hydraulic actuator, the construction machine further comprising:

a return hydraulic fluid selection device that is connected to a bottom side hydraulic fluid chamber and a rod side hydraulic fluid chamber of the first hydraulic actuator via hydraulic lines, selects the rod side hydraulic fluid chamber as a supply source of a return hydraulic fluid at a time of a raising operation of the first hydraulic actuator, and selects the bottom side hydraulic fluid chamber as the supply source of the return hydraulic fluid at a time of a lowering operation of the first hydraulic actuator;

a regeneration line supplying the hydraulic fluid discharged from the return hydraulic fluid selection device to a portion between the second hydraulic actuator and the first hydraulic pump to regenerate the hydraulic fluid;

a discharge line discharging the hydraulic fluid discharged from the return hydraulic fluid selection device to the tank;

a regeneration/discharge flow rate adjustment device capable of adjusting a flow rate of the hydraulic fluid flowing through the regeneration line and a flow rate of the hydraulic fluid flowing through the discharge line;

a hydraulic pilot type first operation device for operating the first hydraulic actuator in a raising direction or a lowering direction; and a hydraulic pilot type second operation device for operating the second hydraulic actuator, wherein the regeneration/discharge flow rate adjustment device has a regeneration control valve capable of diverting or switching the hydraulic fluid discharged from the return hydraulic fluid selection device to the regeneration line and the discharge line, and a discharge valve provided on a downstream side of the regeneration control valve and capable of adjusting the flow rate of the hydraulic fluid discharged to the tank by a pilot pressure outputted from the first operation device;

the construction machine further comprises: a pair of logic valves which output pilot hydraulic fluids when both the pilot hydraulic fluid supplied by the first operation device and the pilot hydraulic fluid supplied by the second operation device are inputted, and a high pressure selection valve selecting a higher of pressures outputted by the pair of logic valves; and the regeneration control valve is driven by the pilot hydraulic fluid outputted via the high pressure selection valve.

* * * * *